US009193165B2

(12) United States Patent
Takano et al.

(10) Patent No.: US 9,193,165 B2
(45) Date of Patent: Nov. 24, 2015

(54) WASTE INK ABSORBER, WASTE INK TANK, AND LIQUID DROPLET EJECTING DEVICE

(71) Applicant: SEIKO EPSON CORPORATION, Tokyo (JP)

(72) Inventors: Hidehiro Takano, Nagano (JP); Shunichi Seki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/140,191

(22) Filed: Dec. 24, 2013

(65) Prior Publication Data

US 2014/0184694 A1 Jul. 3, 2014

(30) Foreign Application Priority Data

Dec. 27, 2012 (JP) ..... 2012-284515
Dec. 27, 2012 (JP) ..... 2012-284522

(51) Int. Cl.
*B41J 2/165* (2006.01)
*B41J 2/17* (2006.01)
*B41J 2/185* (2006.01)

(52) U.S. Cl.
CPC ..... *B41J 2/1721* (2013.01); *B41J 2002/1856* (2013.01)

(58) Field of Classification Search
CPC ..... B41J 2/16523; B41J 2002/1742; B41J 2/1721; B41J 2002/1856
USPC ..... 347/31, 36, 90
See application file for complete search history.

(56) References Cited

U.S. PATENT DOCUMENTS

| | | | | |
|---|---|---|---|---|
| 8,322,820 | B2 | 12/2012 | Hizawa | |
| 2006/0017770 | A1* | 1/2006 | Harada et al. | 347/36 |
| 2011/0080445 | A1* | 4/2011 | Shimizu et al. | 347/31 |
| 2012/0069086 | A1 | 3/2012 | Tanaka | |

FOREIGN PATENT DOCUMENTS

| | | | |
|---|---|---|---|
| JP | 06-198913 | A | 7/1994 |
| JP | 08-112911 | A | 5/1996 |
| JP | 2000-516864 | A | 12/2000 |
| JP | 2001-129020 | A | 5/2001 |
| JP | 2008-132055 | A | 6/2008 |
| JP | 2011-167960 | A | 9/2011 |
| JP | 2012-086551 | A | 5/2012 |
| WO | 94/14397 | A1 | 7/1994 |

* cited by examiner

*Primary Examiner* — Jannelle M Lebron
(74) *Attorney, Agent, or Firm* — Global IP Counselors, LLP

(57) ABSTRACT

To provide a waste ink absorber having excellent permeability and retention performance, in a waste ink absorber to absorb waste ink discharged from a head for ejecting ink, maximum parts where the density is locally high and a low density portion where the density is lower than the high density portion are provided in a single piece of the waste ink absorber.

11 Claims, 9 Drawing Sheets

WASTE INK ABSORBER, WASTE INK TANK, AND LIQUID DROPLET EJECTING DEVICE

CROSS-REFERENCE TO RELATED APPLICATIONS

This application claims priority to Japanese Patent Application No. 2012-284515 filed on Dec. 27, 2012 and Japanese Patent Application No. 2012-284522 filed on Dec. 27, 2012. The entire disclosure of Japanese Patent Application Nos. 2012-284515 and 2012-284522 is hereby incorporated herein by reference.

BACKGROUND

1. Technical Field

The present invention relates to a waste ink absorber, a waste ink tank, and a liquid droplet ejecting device.

2. Background Technology

A liquid ejecting device is known in which a waste liquid receptacle into which liquid discharged from an ejection head flows and a waste liquid absorbing material for absorbing the liquid flowed into the waste liquid receptacle are provided (see, for example, Patent Documents 1 and 2).

Japanese Laid-open Patent Publication No. 2012-86551 (Patent Document 1) and Japanese Laid-open Patent Publication No. 2011-167960 (Patent Document 2) are examples of the related art.

SUMMARY

Problems to Be Solved by the Invention

However, the density of the waste liquid absorber mounted in the aforementioned device is approximately uniform, and therefore there are problems that, in cases where the permeability of the waste liquid with respect to the waste liquid absorber is relatively good, the retention performance for retaining the absorbed waste liquid deteriorates, while in cases where the retention performance of the absorbed waste liquid with respect to the waste liquid absorber is relatively good, the permeability for absorbing the waste liquid deteriorates.

Means Used to Solve the Above-Mentioned Problems

The invention was made to solve at least a part of the aforementioned problems, and is capable of realizing the following embodiments or applied examples.

A waste ink absorber according to the present applied example is a waste ink absorber absorbing waste ink discharged from a head for ejecting ink, and in a single piece of the waste ink absorber, maximum parts where the density is locally high and a low density portion where the density is lower than the maximum parts are provided.

With this structure, the waste ink can be easily impregnated in the low density portion. Further, the maximum parts are a part where the density is high so that the impregnated waste ink can be retained. Accordingly, a waste ink absorber excellent in permeability and retention performance can be provided. The waste ink denotes, for example, ink which was discharged from a head but not reached a medium. Specifically, the waste ink denotes ink generated by flushing for ejecting ink for the purpose of preventing increasing of ink viscosity, etc., or cleaning for forcibly discharging ink with a pump, etc., for the purpose of recovering of a nozzle which became unable to eject ink by increased ink viscosity or destruction of meniscus, influence of paper powder, etc., or preventing increasing of ink viscosity. Further, in the so-called borderless printing, since ink deviated from a medium is also ink which has not reached the medium, it is included in waste ink.

The maximum parts of the waste ink absorber according to the aforementioned applied example are formed by cellulose fibers and does not include thermoplastic resin.

With this structure, the cellulose fibers have higher hydrophilic property than the thermoplastic resin. Accordingly, the maximum parts formed by the cellulose fibers have high hydrophilic property so that the retention performance of the waste ink can be enhanced.

In the waste ink absorber according to the aforementioned applied example, when a vertical direction with respect to a surface of the waste ink absorber is defined as a thickness direction, the maximum parts are spread in a direction along the surface and in the thickness direction.

With this structure, the maximum parts are spread in the direction along the surface and in the thickness direction, and as well as, the low density portion is spread in the same manner. Because of this, since the maximum parts and the low density portion are spread in the both directions, it is spread uniformly in the waste ink absorber so that the permeability and retention property of the waste ink can be secured.

In the waste ink absorber according to the aforementioned applied example, the surface of the waste ink absorber is a flat surface.

With this structure, the surface of the waste ink absorber does not have unevenness. Because of this, it is easy to manage the thickness of the waste ink absorber. Also, it is easy to lay a plurality of waste ink absorbers.

The maximum parts of the waste ink absorbers according to the aforementioned applied example are not connected to each other.

With this structure, the connection between the maximum parts is not existed so that it can be prevented from the reduction of the permeability of the waste ink.

The waste ink absorber according to the aforementioned applied example has the high density portion where the density is higher than the low density portion, and the maximum parts are dispersed in the low density portion.

With this structure, the waste ink can be easily impregnated in the low density portion. Also, the impregnated waste ink can be retained in the high density portion. In addition, the maximum parts are spread in the low density portion. Because of this, the retention ability to retain the absorbed waste ink is enhanced, and in addition, the absorption tolerance of the waste ink can be increased. Accordingly, a waste ink absorber excellent in permeability and retention performance can be provided.

In the waste ink absorber according to the aforementioned applied example, the high density portion and the low density portion are formed in a single piece of the waste ink absorber.

With this structure, the high density portion and the low density portion are uniformly formed in a single piece of the waste ink absorber. Because of this, for example, it is not required to manage the adhesiveness between the respective layers in comparison with the structure that the layer having the high density portion and the layer having the low density portion are separately formed and the respective layers are laid each other. Therefore, it can be easily managed.

In the waste ink absorber according to the aforementioned applied example, the densities are gradually changed from the high density portion to the low density portion in the single piece of the waste ink absorber.

With this structure, since the densities are gradually changed, the permeability and the retention performance are not quickly changed in comparison with the case that a changing point of the densities (boundary) is existed. Accordingly, the permeability and the retention performance can be reliably secured.

In the waste ink absorber according to the aforementioned applied example, the high density portions and the low density portions are alternately laid, and in a plurality of laid high density portions, the densities are gradually increased in a lamination direction.

With this structure, since the low density portions are existed between the laid high density portions where the densities are gradually increased, the permeability in the high density portions, which is reduced, is supported by the adjacent low density portions so as to increase the permeability. Therefore, the permeability of the waste ink in the entire waste ink absorber can be improved and the retention performance of the waste ink in the maximum parts in the low density portions can be improved.

A waste ink tank according to this applied example is characterized in that the waste ink tank is provided with the aforementioned waste ink absorber and a container portion for containing the waste ink absorber.

With this structure, by containing the waste ink absorber having waste ink permeability and retention property, for example, even in cases where the waste ink tank is arranged obliquely or sideways, the absorbed waste ink can be retained to prevent leakage, etc.

A liquid droplet ejecting device according to this applied example is characterized in that the liquid droplet ejecting device is equipped with a head for ejecting ink, and the aforementioned waste ink tank for capturing the waste ink discharged from the head.

With this structure, it becomes possible to provide a highly-reliable liquid droplet ejecting device capable of absorbing waste ink efficiently without causing defects such as ink leakage, etc.

BRIEF DESCRIPTION OF THE DRAWINGS

Referring now to the attached drawings which form a part of this original disclosure.

DETAILED DESCRIPTION OF EXEMPLARY EMBODIMENTS

Hereinafter, the first to third embodiments of the invention will be described in reference to the drawings. In each of the following drawings, the measurement of each member, etc., is shown to be different from the actual measurement in order to attain recognizable size of each member, etc.

First Embodiment

Figure 1A:
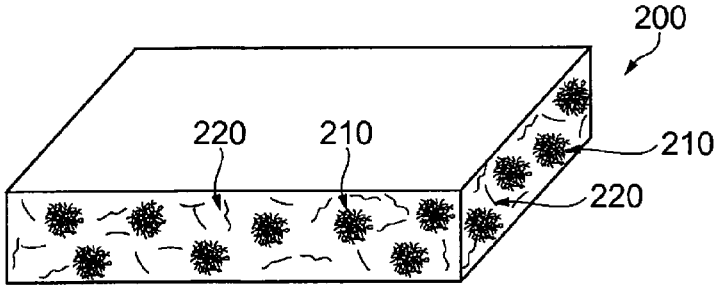
FIGS. 1A-1C are pattern diagrams showing a configuration of a waste ink absorber.
Figure 1B:
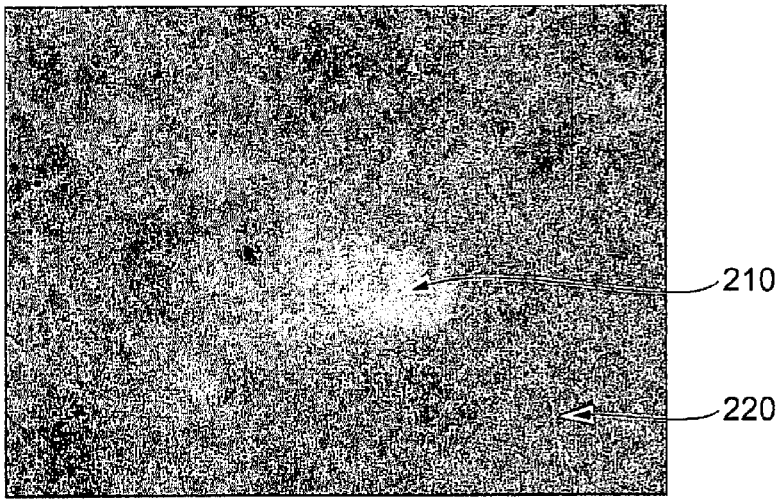
Figure 1C:
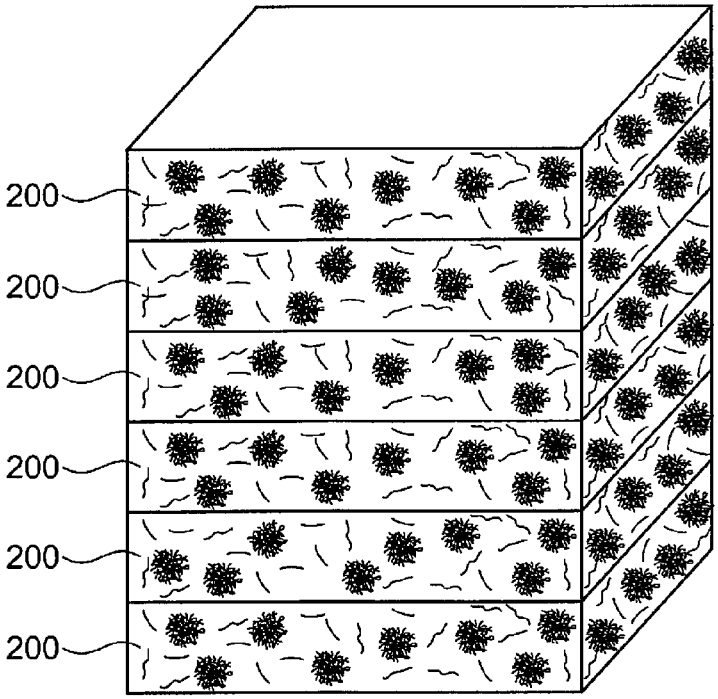

Initially, the structure of the waste ink absorber will be described. FIGS. 1A-1C show a structure of a waste ink absorber. FIG. 1A is a pattern diagram showing the structure of the waste ink absorber, and FIG. 1B is an enlarged photograph showing a maximum part of the waste ink absorber.

A waste ink absorber 200 is used to absorb waste ink discharged from a head for ejecting ink, and as shown in FIG. 1A, in the single piece of the waste ink absorber 200, maximum parts 210 where the density is locally high and a low density portion 220 where the density is lower than the maximum part 210 are provided.

The waste ink absorber 200 is constituted by a mixture of cellulose fibers, thermoplastic resin, and flame retardant. And, the maximum parts 210 are formed by the cellulose fibers and do not include the thermoplastic resin. Also, when a vertical direction with respect to a surface of the waste ink absorber 200 is defined as a thickness direction, the maximum parts 210 are dispersed in a direction along the surface and in the thickness direction. That is, the maximum parts 210 and the low density portion 220 are spread in balance in the direction along the surface and in the thickness direction. Also, the maximum parts 210 are spread without connecting each other. Since the maximum parts 210 are formed by the cellulose fibers, the hydrophilic property is higher in comparison with the low density portion 220 where the thermoplastic resin is included. Because of this, the absorbed waste ink can be retained. Also, the waste ink can be quickly absorbed from the portion 220 where the density is low.

The cellulose fibers are obtained by fibrillating a pulp sheet, etc., using, for example, a dry type fibrillation machine such as a rotary crushing apparatus, etc. And, when the fibrillating is performed, the maximum parts 210 are formed with the desired density by entangling a part of cellulose fibers of the defibrated cellulose fibers. For example, as shown in FIG. 1B, the maximum parts 210 having approximately 1 mm in diameter are formed by entangling the defibrated cellulose fibers each other. Also, the low density portion 220 is existed around the maximum part 210.

The thermoplastic resin contributes to bonding of cellulose fibers, retention of appropriate strength (hardness, etc.) of the waste ink absorber 200, prevention of scattering of paper powder/fibers, and maintaining of the shape at the time of absorbing waste ink. The thermoplastic resin allows adaption of any configurations such as a fiber form or a powder form. By heating the mixture in which the cellulose fibers and the thermoplastic resin are mixed, the thermoplastic resin can be thermoplastic, the cellulose fibers are bonded each other. It is preferable that the welding is performed at a temperature not causing thermal deterioration of the cellulose fibers, etc. The thermoplastic resin is preferably a fibrous resin which is easily tangled with paper fibers in the fibrillated fabric. Further, it is preferable to be a composite fiber of a core-in-sheath structure. In the thermoplastic resin of the core-in-sheath structure, the peripheral sheath portion melts at a low temperature, and the fibrous core portion is bonded to the thermoplastic resin itself or the cellulose fiber, resulting in a strong juncture.

The flame retardant is added to give flame retardant properties to the waste ink absorber 200. As the flame retardant, for example, inorganic materials such as aluminum hydroxide, magnesium hydroxide, and the like, or phosphoric organic materials (e.g., aromatic ester phosphate such as triphenylphosphate, and the like) can be used.

As a method of forming the waste ink absorber 200, for example, a mixture in which cellulose fibers, thermoplastic resin and flame retardant are mixed is screened to accumulate on a mesh belt arranged below the screen so as to form a deposited material. Then, the formed deposited material is subjected to a pressurization and heating treatment. Because of this, the thermoplastic resin is fused to obtain a desired thickness. In addition, by subjecting it to die cutting into a desired size, the waste ink absorber 200 is formed. Also, the surface of the waste ink absorber 200 is formed in a flat surface without surface unevenness.

FIG. 1C is a schematic view showing a structure laminating plural pieces of the waste ink absorber. As shown in FIG. 1C, a plurality of waste ink absorbers 200 is laid. The present embodiment shows a structure where six waste ink absorbers are laid. Also, among the surfaces to configure the waste ink absorbers 200, the widest surfaces are contacted each other. Accordingly, the permeability of the waste ink is secured, and the absorption tolerance of the waste ink can be increased. By the way, the structure of each of the waste ink absorbers 200 is the same structure as described FIG. 1A, and therefore, the explanation is omitted.

Figure 2A:
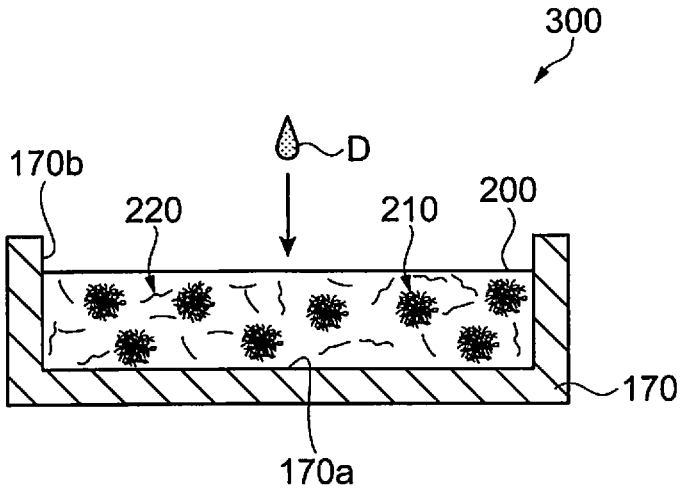
FIGS. 2A and 2B are schematic views showing a configuration of a waste ink tank.
Figure 2B:
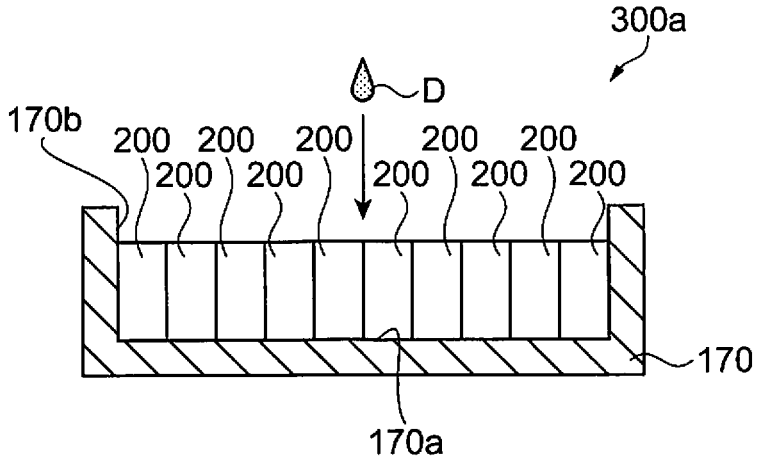

Next, a structure of a waste ink tank will be described. FIGS. 2A and 2B are cross-sectional views showing a structure of the waste ink tank. As shown in FIG. 2A, the waste ink tank 300 is provided with the waste ink absorber 200 that absorbs waste ink, and an container portion 170 that accommodates the waste ink absorber 200.

In the side cross-sectional view, the waste ink absorber 200 is provided with maximum parts 210 where the density is high and low density portions 220 where the density is lower than the maximum parts 210. By the way, the detailed structure of the waste ink absorber 200 is the same structure as described in FIGS. 1A-1C, and therefore the explanation is omitted.

The container portion 170 for containing the waste ink absorbers 200 is rectangularly formed by, for example, a plastic material. The container portion 170 includes a bottom surface portion 170*a* and a side surface portion 170*b*, and is formed so as to be able to contain and retain the waste ink absorbers 200.

And, as shown in FIG. 2A, the waste ink droplet D is discharged toward the waste ink absorber 200 and when it reaches to the surface of the waste ink absorber 200, the waste ink droplet D is efficiently absorbed from the low density portion 200 that is presented on the surface of the waste ink absorber 200. And, the absorbed waste ink is retained by the maximum parts 210 where the density is high.

By the way, the waste ink tank can be configured by laminating the plurality of waste ink absorbers 200. FIG. 2B shows a structure of the waste ink tank 300*a* in which the plurality of waste ink absorbers 200 is laid. As shown in FIG. 2B, for example, ten pieces of the waste ink absorbers 200 are laid, and the widest surfaces of the waste ink absorbers 200 are arranged in a vertical direction (vertical arrangement). By the way, the number of laminations of the waste ink absorbers 200 can be properly set. In this structure, the absorption tolerance to absorb the waste ink can be increased.

Second Embodiment

First, a structure of a liquid absorber will be described. The liquid absorber is to absorb liquid, and in the absorber, a portion where the density is high and a low density portion where the density is lower than the high density portion are provided. A maximum part where the density is higher than the low density portion is locally provided in the low density portion. By the way, in the present embodiment, the structure of the waste ink absorber will be exemplarily described as a liquid absorber.

Figure 3A:
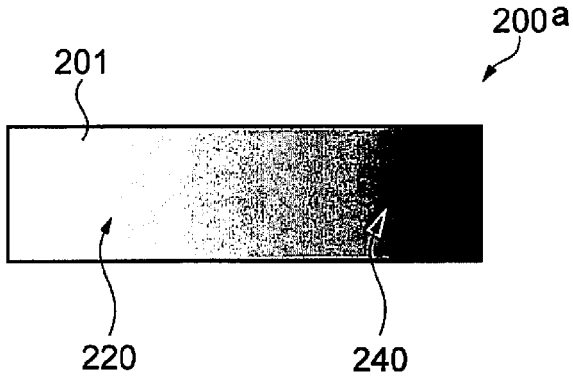
FIGS. 3A-3C are the structure of the waste ink absorber according to the second embodiment.
Figure 3B:
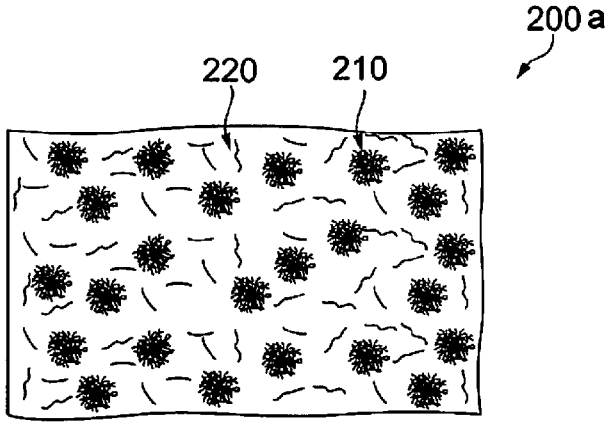
Figure 3C:
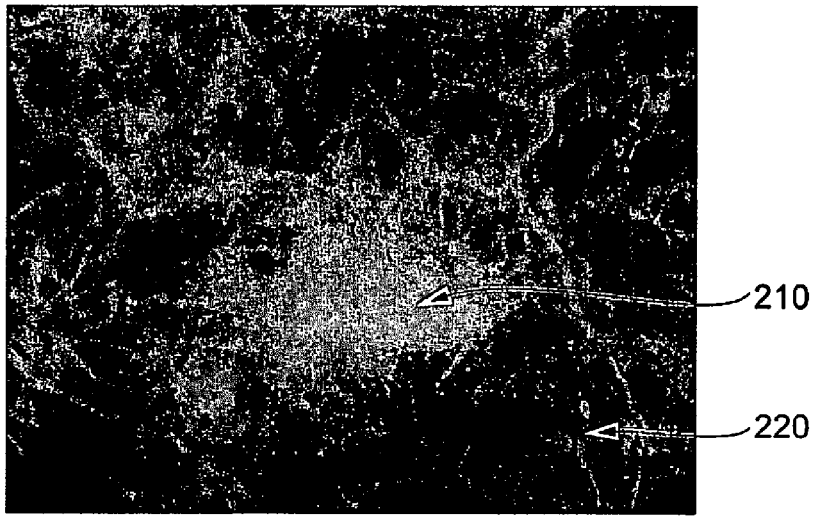

FIGS. 3A-3C show the structure of the waste ink absorber according to the second embodiment, and FIG. 3A is a pattern diagram showing the structure of the waste ink absorber. That is, it is a schematic diagram in the case that the plain surface 201 of the rectangular waste ink absorber 200*a* is observed. As shown in FIG. 3A, in the waste ink absorber 200*a*, a portion 240 where the density is high and a portion 220 where the density is lower than the high density portion 240 are provided. The waste ink absorber 200*a* has the high density portion 240 and the low density portion 220 in a single piece structure (single body). The densities are gradually changed from the high density portion 240 to the low density portion 220 in the single piece of the waste ink absorber 200*a*. Specifically, the densities are gradually reduced from the high density portion 240 to the low density portion 220.

The waste ink absorber 200*a* of the present embodiment absorbs waste ink discharged from the head, which ejects ink as liquid, and for example, it is mounted in the waste ink tank. In the single piece of the waste ink absorber 200*a* that is not mounted in the waste ink tank, the portion 220 where the density is low and the high density portion 240 are provided on the plain surface 201. And, in the case that it is not mounted in the waste ink tank, in other words, in the case that it is not deformed by compressing the waste ink absorber 200*a*, the thickness of the waste ink absorber 200*a* is evenly formed.

FIG. 3B is an enlarged diagram of the low density portion, and FIG. 3C is an enlarged photograph showing the maximum part of the waste ink absorber. The low density portion 220 of the waste ink absorber 200*a* according to the present embodiment has the maximum parts 210 where the density is locally higher than the low density portion 220. The maximum parts 220 are distributed in equilibrium so that the maximum parts 210 are not connected each other. Also, the low density portion 220 is existed around the maximum parts 210. By existence of the maximum parts 210 in the low density portion 220, the retention ability to retain the waste ink can be more enhanced. Also, in the portion 240 where the density is high, the absorbed waste ink can be retained.

The waste ink absorber 200*a* is constituted by a mixture including cellulose fibers, thermoplastic resin and flame retardant. The cellulose fibers are obtained by fibrillating a pulp sheet, etc., using, for example, a dry type fibrillation machine such as a rotary crushing apparatus, etc. And, when the fibrillating is performed, the maximum parts 210 are formed with the desired density by entangling a part of cellulose fibers of the defibrated cellulose fibers. For example, as shown in FIG. 3C, the maximum parts 210 having approximately 1 mm in diameter are formed by entangling the defibrated cellulose fibers each other.

The thermoplastic resin contributes to bonding of cellulose fibers, retention of appropriate strength (hardness, etc.) of the waste ink absorber 200*a*, prevention of scattering of paper powder/fibers, and maintaining of the shape at the time of absorbing waste ink. The thermoplastic resin allows adaption of any configurations such as a fiber form or a powder form. By heating the mixture in which the cellulose fibers and the thermoplastic resin are mixed, the thermoplastic resin can be thermoplastic, welded to the cellulose fibers are bonded each other. It is preferable that the welding is performed at a temperature not causing thermal deterioration of the cellulose fibers, etc. The thermoplastic resin is preferably a fibrous resin which is easily tangled with paper fibers in the fibrillated fabric. Further, it is preferable to be a composite fiber of a core-in-sheath structure. In the thermoplastic resin of the core-in-sheath structure, the peripheral sheath portion melts at a low temperature, and the fibrous core portion is bonded to the thermoplastic resin itself or the cellulose fiber, resulting in a strong juncture.

The flame retardant is added to give flame retardant properties to the waste ink absorber 200*a*. As the flame retardant, for example, inorganic materials such as aluminum hydroxide, magnesium hydroxide, etc. or phosphoric organic materials (for example, such as aromatic ester phosphate such as triphenylphosphate) can be used.

As a method of forming the waste ink absorber 200*a*, for example, a mixture in which cellulose fibers, thermoplastic resin and flame retardant are mixed is screened to accumulate on a mesh belt arranged below the screen so as to form a predetermined shape to thereby form a deposited material. Then, the formed deposited material is subjected to a pressurization and heating treatment. With this, the thermoplastic resin is fused to obtain a predetermined thickness. By subjecting it to die cutting into a desired size, a waste ink absorber 200*a* is formed.

Figure 4A:
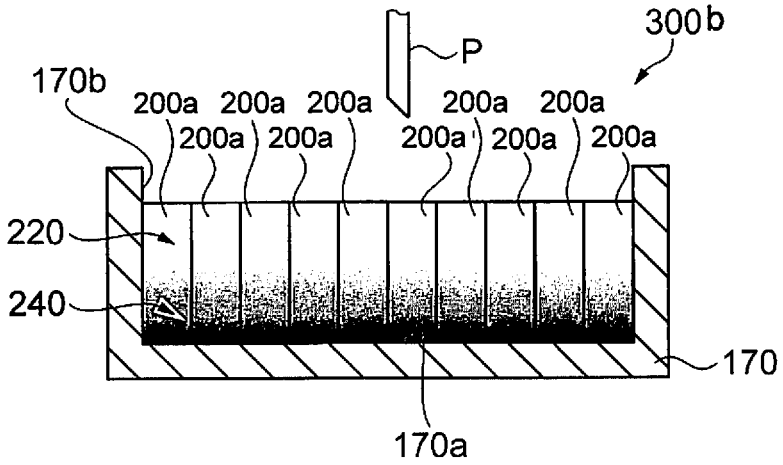
FIGS. 4A and 4B are the structure of a waste ink tank according to the second embodiment.
Figure 4B:
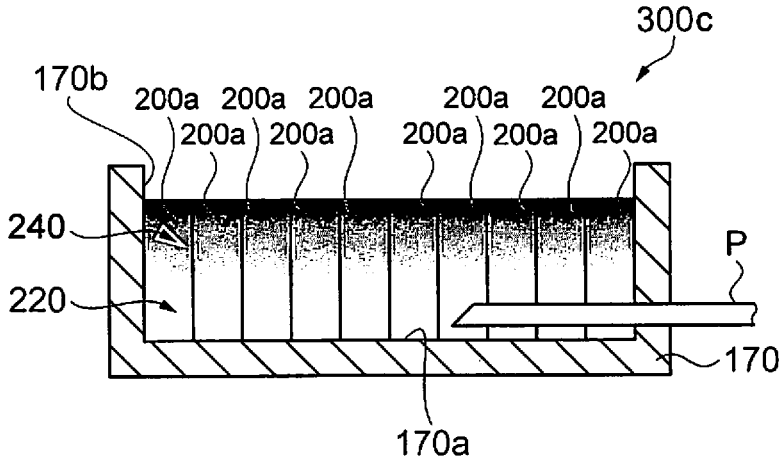

Next, the structure of a waste ink tank will be explained. FIGS. 4A and 4B show the structure of a waste ink tank according to the second embodiment, and FIG. 4A is a cross-sectional view. As shown in FIG. 4A, the waste ink tank 300*b* is provided with a waste ink absorber 200*a* that absorbs waste ink, and an container portion 170 for containing the waste ink absorber 200*a*.

The container portion part 170 for containing the waste ink absorbers 200*a* is formed into a rectangular shape by, for example, a plastic material. The container portion 170 includes a bottom surface part 170*a* and a side surface part 170*b*, and is formed so as to be able to contain and retain the waste ink absorbers 200*a*.

The structure of the waste ink absorbers 200*a* is the same structure as shown in FIGS. 3A-3C, and therefore the explanation will be omitted. In this embodiment, a plurality of waste ink absorbers 200*a* are laid and mounted. By the way, in FIG. 4A, the high density portion 240 is arranged to contact to the bottom surface 170*a* side. In this case, it is preferable that the discharge spout of a pipe P for discharging waste ink is arranged at the position facing the low density portion 220.

When the waste ink is discharged toward the waste ink absorbers 200*a* via the pipe P, the waste ink comes into contact with the low density portion 220 of the waste ink absorbers 200*a* and impregnated into the inside of the waste ink absorbers 200*a*. And, the absorbed waste ink is retained by the high density portion 240.

Next, the structure of another waste ink tank will be explained. FIG. 4B is a cross-sectional view showing the structure of another waste ink tank. As shown in FIG. 4B, the waste ink tank 300*c* is provided with the waste ink absorber 200*a* that absorbs the waste ink, and the container portion 170 for containing the waste ink absorber 200*a*. By the way, the structure of the waste ink absorber 200*a* is the same as the structure shown in FIG. 3A, and the explanation is omitted. In FIG. 4B, a plurality of waste ink absorbers 200*a* is laid in contact with each other. The waste ink absorbers are arranged so that the low density portion 220 comes into contact with the bottom surface portion 170*a* side. In this case, it is preferable that the pipe P is inserted into the low density portion 220 so that the discharge spout of the pipe P through which waste ink is discharged is positioned at the low density portion 220. By employing such configuration, in the same manner as mentioned above, the discharged waste ink can be easily impregnated into the waste ink absorber 200 and the absorbed waste ink can be retained.

Figure 5:
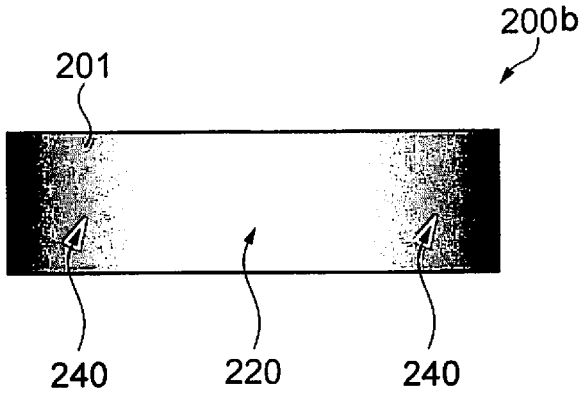
FIG. 5 is a schematic diagram showing a structure of a waste ink absorber according to another embodiment.

By the way, the structure of the waste ink absorber is not limited to the aforementioned structure. FIG. 5 is a schematic diagram showing a structure of a waste ink absorber according to another embodiment. As shown in FIG. 5, in the waste ink absorber 200*b*, a portion 240 where the density is high and a low density portion 220 where the density is lower than the high density portion 240 are provided. The waste ink absorber 200*b* has the high density portion 240 and the low density portion 220 in a single piece structure (single body). And, in the planar surface 201, the high density portion 240 is formed in both ends side, and the low density portion is formed in the central part. In the case that it is not installed in the waste ink tank, in other words, in the case that it is not deformed by compressing the waste ink absorber 200*b*, the thickness of the waste ink absorber 200 is evenly formed. Also, in the waste ink absorber 200*b*, the densities are gradually changed from the high density portion 240 to the low density portion 220 in the single piece of the waste ink absorber 200*b*. Specifically, the densities are gradually reduced from the high density portion 240 to the low density portion 220. Also, in the same manner as the waste in absorber 200*a* in FIGS. 3A-3C, the low density portion 220 locally includes maximum parts (not shown) where the density is higher than the low density portion 220 in the waste ink absorber 200*b*. The maximum parts 220 are distributed in equilibrium so that the maximum parts 210 are not connected each other.

In the waste ink absorber 200*b* formed as mentioned above, at the portion 220 low in density, waste ink can be easily impregnated, and at the portion 240 high in density, absorbed waste ink can be retained. In addition, by the existence of the maximum parts, the retention ability to retain the absorbed waste ink can be enhanced. By the way, the mixture of the waste ink absorber 200*b*, the formation method, and the like are the same manner as the waste ink absorber 200*a* (see FIGS. 3A-3C) so that the explanation is omitted.

Third Embodiment

Next, the third embodiment will be explained.

Figure 6:
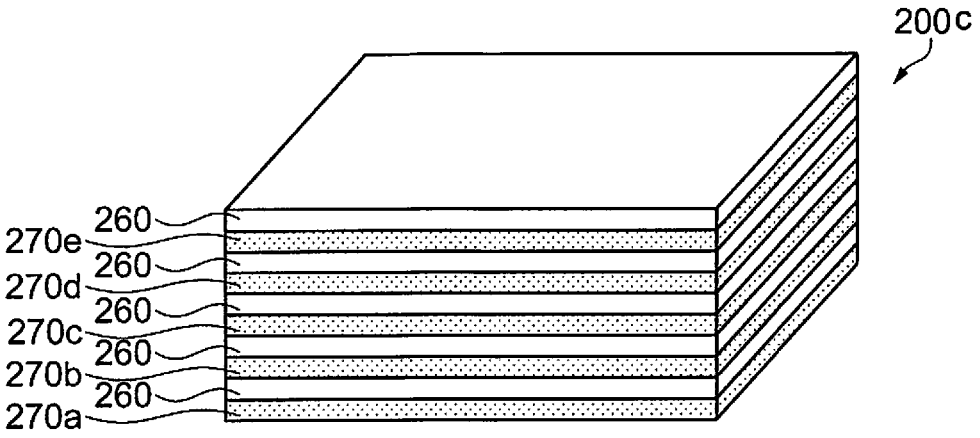
FIG. 6 is a schematic view showing the structure of a waste ink absorber according to the third embodiment.

Initially, the structure of a waste ink absorber will be explained. FIG. 6 is a schematic view showing the structure of a waste ink absorber according to the third embodiment.

As shown in FIG. 6, in the waste ink absorber 200*c*, the high density portions 270*a* to 270*e* and the low density portions 260 are alternately laid. In the present embodiment, the five high density portions 270*a* to 270*e* and the five low density portions 260 are respectively and alternately laid. Specifically, a low density portion 260 is laid on a high density portion 270*a*. A high density portion 270*b* is laid on the low density portion 260. A low density portion 260 is laid on the high density portion 270*b*. A high density portion 270*c* is laid on the low density portion 260. A low density portion 260 is laid on the high density portion 270*c*. A high density portion 270*d* is laid on the low density portion 260. A low density portion 260 is laid on the high density portion 270*d*. A high density portion 270*e* is laid on the low density portion 260. A low density portion 260 is laid on the high density portion 270*e*. By the way, the five high density portions 270*a* to 270*e* and the five low density portions 260 are alternately laid in the present embodiment, but the numbers of the laminations are not limited.

Further, in the waste ink absorber 200*c* of the present embodiment, in the plurality of laid high density portions 270*a* to 270*e*, the densities are gradually changed in the lamination direction. In detail, it is configured that the densities are gradually increased from the high density portion 270*e*, which is laid in the upper side, to the high density portion 270*a*, which is laid in the lower side. The density is defined from at least one of cellulose fibers, thermoplastic resin, and flame retardant included in the waste ink absorber 200*c*.

The low density portions 260 locally have maximum parts (not shown) where the density is higher than the low density portions 260. By the way, the maximum parts are configured in the same manner as the second embodiment so that the description is omitted. Also, the formation method, and the like for the waste ink absorber 200*c* is performed in the same manner as the second embodiment so that the description is omitted.

In such formation of the waste ink absorber 200*c*, the densities are gradually increased in the laid high density portions 270*a* to 270*e*, and by arranging the low density portions 260 between the high density portions 270*a* to 270*e*, the waste ink can be efficiently impregnated. Also, the retention performance to retain the waste ink absorbed by the maximum parts in the low density portions 260 can be enhanced.

Figure 7:
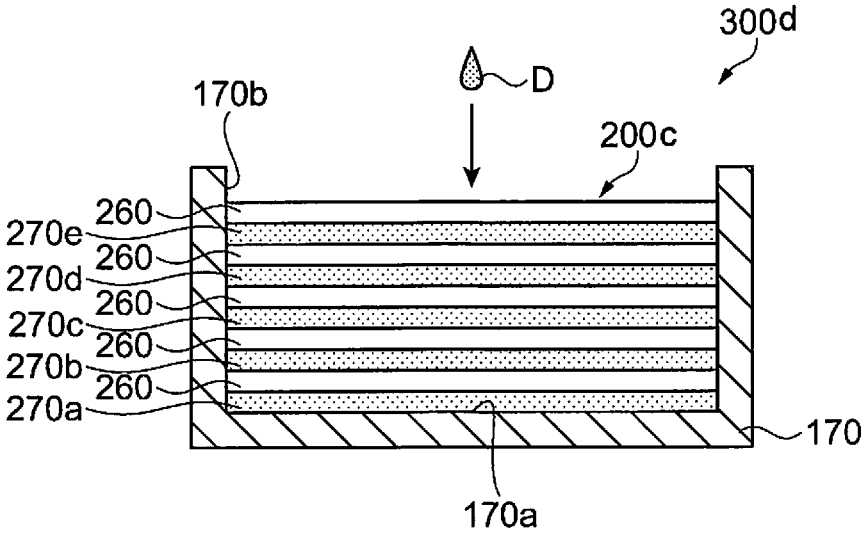
FIG. 7 is a cross-sectional view showing the structure of a waste ink tank according to the third embodiment.

Next, the structure of a waste ink tank will be explained. FIG. 7 is a cross-sectional view showing the structure of a waste ink tank according to the third embodiment. As shown in FIG. 7, the waste ink tank 300*d* is provided with the waste ink absorber 200*c* that absorbs waste ink, and an container portion for containing the waste ink absorber 200*c*.

The container portion 170 for containing the waste ink absorbers 200*c* is formed into a rectangular shape by, for example, plastic material. The container portion 170 includes a bottom surface part 170*a* and a side surface part 170*b*, and is formed to be able to contain and retain the waste ink absorbers 200*c*.

The structure of the waste ink absorber 200*c* is the same structure shown in FIG. 6, and therefore the explanation will be omitted. In the present embodiment, the high density portion 270*a* in the waste ink absorber 200*c* is arranged to contact the bottom surface part 170*a* of the container portion 170. That is, among the high density portions 270*a* to 270*e*, the portion where the density is the highest is arranged in the lower side and the portion where the density is the lowest is arranged in the upper side. In such arrangement, the waste ink can be efficiently impregnated. Specifically, as shown in FIG. 7, when the waste ink droplet D is discharged toward the waste ink absorber 200*c* and reaches to the surface of the waste ink absorber 200*c*, the waste ink droplet D is impregnated from the low density portion 260 presented on the surface of the waste ink absorber 200*c*. And, the waste ink is impregnated from the high density portion 270*e* to the high density portion 270*a* where the densities are gradually increased. By the way, since the low density portions 260 are existed between the high density portions 270*a* to 270*e*, the impregnation of the waste ink is not inhibited. The waste ink absorbed by the high density portions 270*a* to 270*e* where the densities are gradually increased is retained. In addition, the retention ability to retain the waste ink is more improved by the maximum parts of the low density portions 260.

Next, the structure of a liquid droplet ejecting device will be explained. The liquid droplet ejecting device is equipped with a head for ejecting ink and a waste ink tank for capturing the waste ink discharged from the head. By the way, in the liquid droplet ejecting device of this embodiment, the structure equipped with the aforementioned waste ink absorber 200 (200*a*, 200*b*, 200*c*) and the waste ink tank 300 (300*a*, 300*b*, 300*c*, 300*d*) will be explained.

Figure 8:
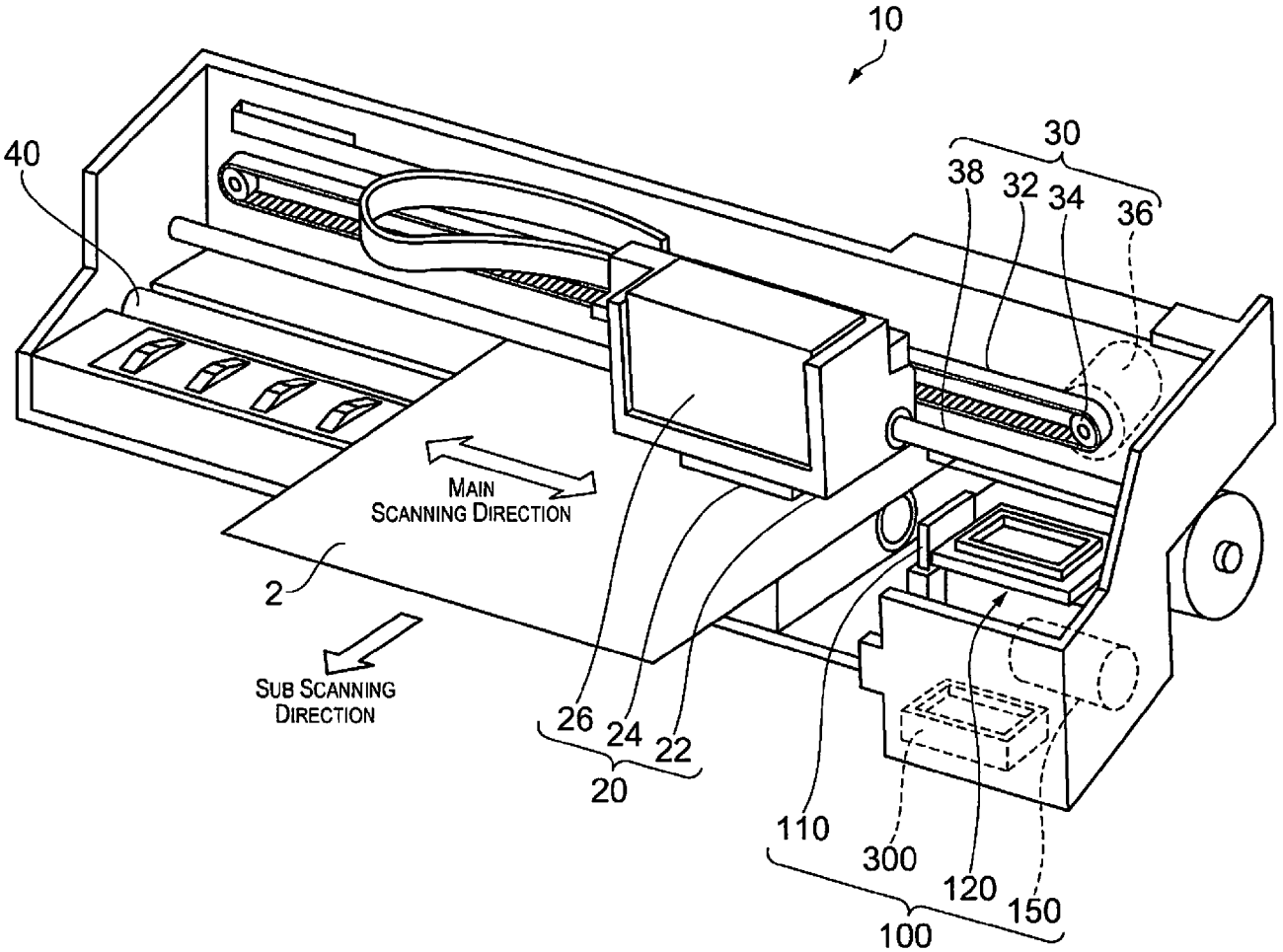
FIG. 8 is a schematic view showing a configuration of a liquid droplet ejecting device.

FIG. 8 is a schematic view showing the structure of the liquid droplet ejecting device. As shown in FIG. 8, the liquid droplet ejecting device 10 is constituted by, e.g., a carriage 20 that forms ink dots on a printing medium 2 such as a printing paper while reciprocating in the main scanning direction, a drive mechanism 30 for reciprocating the carriage 20, a platen roller 40 for feeding the print medium 2, and a maintenance mechanism 100 for performing maintenance to enable normal printing, etc. The carriage 20 is provided with an ink cartridge 26 containing ink, a carriage case 22 for attaching the ink cartridge 26, a head 24 for ejecting ink mounted on the bottom surface side (the side facing the printing medium 2) of the carriage case 22, etc. In the head 24, a plurality of nozzles for ejecting ink are formed. The ink in the ink cartridge 26 is introduced to the head 24, and ejected onto the printing medium 2 by the exact amount to thereby print an image.

The drive mechanism 30 for reciprocating the carriage 20 is constituted by the guide rail 38 extending in the main scanning direction, a timing belt 32 having a plurality of teeth on the inside, a driving pulley 34 engaged with the teeth of the timing belt 32, a step motor 36 for driving the driving pulley 34, etc. A part of the timing belt 32 is fixed to the carriage case 22, and by driving the timing belt 32, the carriage case 22 can be moved along the guide rail 38. Further, since the timing belt 32 and the driving pulley 34 are engaged with each other by the teeth, when the driving pulley 34 is driven by the step motor 36, it is possible to move the carriage case 22 depending on the driven amount with high accuracy.

The platen roller 40 for feeding the printing medium 2 is driven by non-illustrated driving motor and gear mechanism, so that the printing medium 2 can be fed by a certain amount in a sub scanning direction.

The maintenance mechanism 100 is arranged in a region called a home position located outside the printing region, and is provided with a wiper blade 110 for sweeping the surface (nozzle surface) to which an ejection nozzle is formed on the bottom surface side of the head 24, a cap unit 120 for capping the head 24 by being pressed against the nozzle surface of the head 24, and a suction pump 150 for discharging ink as waste ink by being driven in a state in which the head 24 is capped with the cap unit 120. The suction pump forcibly discharges ink from the head 24 to thereby recover the nozzle which became unable to eject ink due to increased ink viscosity, destruction of meniscus, influence of paper powder, etc., or prevent the ink in the nozzle from being increased in ink viscosity. Further, below the suction pump 150, a waste ink tank 300 (300*a*, 300*b*, 300*c*, 300*d*) for capturing the waste ink discharged from the suction pump 150 is provided. By providing the waste ink tank 300, the outer shape of the liquid droplet ejecting device 10 increases. By improving the ink permeability and retaining properties of the waste ink absorber 200 (200*a*, 200*b*, 200*c*), the volume of the waste ink absorber 200 capable of retaining the same amount of ink can be reduced. With this, the size of the waste ink tank 300 and liquid droplet ejecting device 10 is reduced. The waste ink tank 300 has the same structure as the structure explained with reference to FIGS. 2A and 2B, and therefore the explanation will be omitted. The discharged ink also includes ink by flushing that flushes ink for the purpose of ink viscosity increase prevention, and ink failed to reach a medium such as the ink ejected outside a medium in the so-called borderless printing. Therefore, the waste ink is not limited to the ink discharged by the suction pump 150. The waste ink denotes ink which was discharged from the head 24 but not reached a medium.

According to the aforementioned embodiments, the following effects can be obtained.

(1) The waste ink can be easily impregnated in the low density portion 220. Also, the maximum part 210 is a portion where the density is high, and also, since it is formed by cellulose fibers, the absorbed waste ink can be retained. Because of this, accordingly, the waste ink absorber 200 having excellent permeability and retention property can be provided.

(2) In the waste ink tanks 300 (300*a*, 300*b*, 300*c*, 300*d*) in which the above waste ink absorber 200 (200*a*, 200*b*, 200*c*) is provided, even when the waste ink tanks 300 is arranged obliquely or slightly sideways, the absorbed waste ink is retained, and therefore the leakage thereof, etc., can be prevented.

(3) In the liquid droplet ejecting device 10 provided with the aforementioned waste ink tanks 300, it is possible to efficiently absorb the waste ink discharged from the head 24, prevent generation of defects such as ink leakage, etc., and secure the reliability.

(4) In the waste ink absorbers 200*a*, 200*b*, the waste ink can be easily impregnated in the low density portions 220, and the absorbed waste ink can be retained in the high density portions 240. In addition, the retention ability to retain the waste ink can be more enhanced by the maximum parts 210 existed in the low density portions 220.

(5) In the waste ink absorber 200*c* the high density portions 270*a* to 270*e* and the low density portions 260 are alternately laid and the densities of the laid high density portions 270*a* to 270*e* are gradually increased. By arranging the low density portions 260 between the high density portions 270*a* to 270*e*, the waste ink can be efficiently impregnated. Also, the retention performance to retain the waste ink absorbed by the maximum parts in the low density portions 260 can be more enhanced.

EXAMPLES

Next, the concrete examples according to the invention will be described.

1. Mixture (1) Cellulose Fibers

A pulp sheet cut into a few centimeters using a cutting machine was fibrillated into a cotton-like manner with a turbo mill (made by Turbo Corporation).

(2) Thermoplastic Resin

The thermoplastic resin had a core-in-sheath structure. The sheath was polyethylene melting at 100° C. or above, and the core was a thermoplastic fiber of 1.7 dtex (Tetron, made by Teijin Ltd.) made of polyester.

(3) Flame Retardant

Aluminum hydroxide B53 (made of Nippon Light Metal Company, Ltd.).

2. Formation of Waste Ink Absorber

Example 1

Formation of Waste Ink Absorber A

A mixture C1 in which 100 weight parts of cellulose fibers, 15 weight parts of thermoplastic resin, and 10 weight parts of flame retardant were mixed in air was screened with mesh size of 5 mm to cause accumulation on the mesh belt. At this time, it was made to cause the material deposit on the mesh belt while suctioning by the suction device. And, the deposited material was subjected to a heating and pressurization treatment at 200° C. After that, the deposited material was cut into 150 mm×50 mm×12 mm to form a waste ink absorber A. When the density of the waste ink absorber A was measured, the low density portions where the density was lower than the maximum parts were formed.

Example 2

Formation of Waste Ink Absorber B

A mixture C2' in which 100 weight parts of cellulose fibers, 15 weight parts of thermoplastic resin, and 10 weight parts of flame retardant were mixed in air was screened with mesh size of 3 mm so as to form a mixture C2. Also, the mixture, which was not screened (the remains in the screen) at the time that the mixture C2' was screened with mesh size of 3 mm into the aforementioned mixture C1, was mixed so as to from the mixture C3. Accordingly, the mixture C3 has high content ratio of the maximum parts. On the other hand, the mixture C2 has low content ratio of the maximum parts. And, the mixture C2 and the mixture C3 were alternately deposited on the mesh belt. In Example 2, the mixture C2 and the mixture C3 were alternately deposited by six times. And, the deposited material was subjected to the heating and pressurization treatment at 200° C. After that, the deposited material was cut into 150 mm×50 mm×12 mm to from the waste ink absorber B. When the density of the waste ink absorber B was measured, a layer in which the content ratio of the maximum parts of high density was high and a layer in which the content ratio of the maximum parts of high density was low were formed.

Comparative Example 1

Formation of Waste Ink Absorber R

A mixture C2' in which 100 weight parts of cellulose fibers, 15 weight parts of thermoplastic resin, and 10 weight parts of flame retardant were mixed in air was screened with mesh size of 3 mm so as to form the mixture C2. And, the mixture C2 was deposited on the mesh belt. The deposited material was subjected to the heating and pressurization treatment at 200° C. After that, the deposited material was cut into 150 mm×50 mm×12 mm to form the waste ink absorber R. When the density of the waste ink absorber R is measured, the layer where the content ratio of the maximum parts of the high density was low was formed.

Example 3

Formation of Waste Ink Absorber C

Figure 9A:
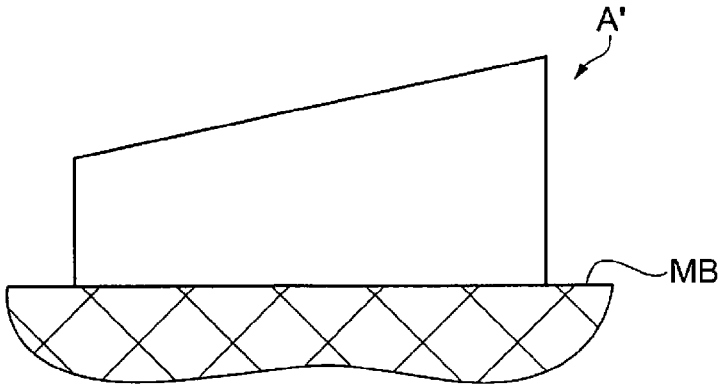
FIGS. 9A-9C are process charts showing a formation method of a waste ink absorber according to Example 1.
Figure 9B:
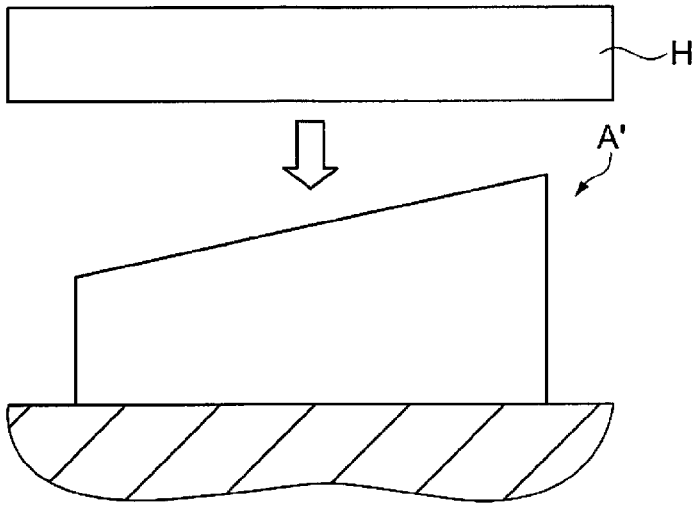
Figure 9C:
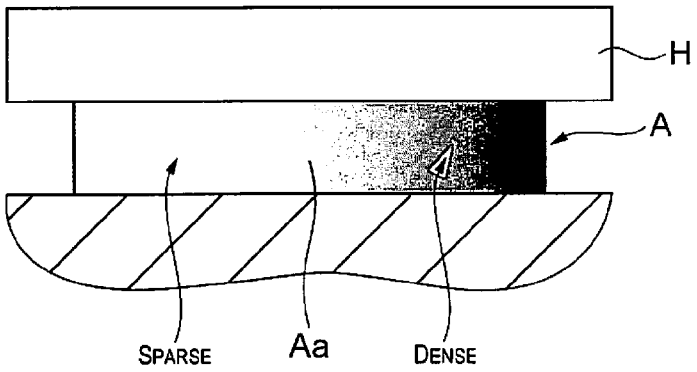

FIGS. 9A-9C are process charts showing a formation method of a waste ink absorber according to Example 1. First, as shown in FIG. 9A, a mixture in which 100 weight parts of cellulose fibers, 15 weight parts of thermoplastic resin, and 10 weight parts of flame retardant were mixed in air was screened with mesh size of 5 mm to cause accumulation on the mesh belt MB so as to form the deposited material A'. At this time, the material was deposited so that the thickness of the material became different with respect to the mesh belt MB surface. In this Example, the deposited material A' was formed to become one end part of the thickness thicker than the other end part. And, the deposited material A' was subjected to the heating and pressurization process. At this time, as shown in FIGS. 9B and 9C, a heated flat plate H, which was heated at 200° C., was pressed against the deposited material A' to compress it into a predetermined thickness. In this Example, the deposited material A' was formed so that the thickest portion of the deposited material A' was compressed into ⅛ and the thinnest portion thereof was compressed into ⅕ to form a predetermined thickness (see FIG. 9A). Thereafter, the deposited material A' was cut into 150 mm×50 mm×12 mm to form a waste ink absorber A. The density of the waste ink absorber A was observed. When the density of the waste ink absorber A was measured, in the direction of the plain surface Aa, the high density portion (0.21 g/cm$^3$) was formed in the portion corresponding to the thickest part, and the low density portion (0.13 g/cm$^3$) was formed in the portion corresponding to the thinnest part. Further, in the waste ink absorber A, the density was changed from high to low toward the thinnest portion in the deposits A' from the thickest portion. Also, in the low density portion, the maximum parts where the density was higher than the low density portion were formed.

Example 4

Formation of Waste Ink Absorber D a: Formation of Mixture E1

A mixture E1' in which 100 weight parts of cellulose fibers, 25 weight parts of thermoplastic resin, and 10 weight parts of flame retardant were mixed in air was screened with mesh size of 3 mm so as to form the mixture E1.

b: Formation of Mixture E2

A mixture E2' in which 100 weight parts of cellulose fibers, 23 weight parts of thermoplastic resin, and 10 weight parts of flame retardant were mixed in air was screened with mesh size of 3 mm so as to form the mixture E2.

c: Formation of Mixture E3

A mixture E3' in which 100 weight parts of cellulose fibers, 21 weight parts of thermoplastic resin, and 10 weight parts of flame retardant were mixed in air was screened with mesh size of 3 mm so as to form the mixture E3.

d: Formation of Mixture E4

A mixture E4' in which 100 weight parts of cellulose fibers, 19 weight parts of thermoplastic resin, and 10 weight parts of flame retardant were mixed in air was screened with mesh size of 3 mm so as to form the mixture E4.

e: Formation of Mixture E5

A mixture E5' in which 100 weight parts of cellulose fibers, 17 weight parts of thermoplastic resin, and 10 weight parts of flame retardant were mixed in air was screened with mesh size of 3 mm so as to form the mixture E5.

f: Formation of Mixture E6

A mixture E6' in which 100 weight parts of cellulose fibers 100, 15 weight parts of thermoplastic resin, and 10 weight parts of flame retardant were mixed in air was screened with mesh size of 3 mm so as to form the mixture E6. By the way, among the respective mixtures, the density of the mixture E1 is the highest (0.17 g/cm$^3$) and the density of the mixture E6 is the lowest (0.15 g/cm$^3$).

g: Formation of Mixture E7

The densities are gradually reduced from the mixture E1 to the mixture E6. A mixture E7' in which 100 weight parts of cellulose fibers, 15 weight parts of thermoplastic resin 15, and 10 weight parts of flame retardant were mixed was screened with mesh size of 5 mm so as to form the mixture E7 (density 0.15 g/cm$^3$). First, the mixture E1 was deposited on the mesh belt MB. Next, the mixture E7 was deposited on the deposited mixture E1. Next, the mixture E2 was deposited on the deposited mixture E7. Next, the mixture E7 was deposited on the deposited mixture E2. Next, the mixture E3 was deposited on the deposited mixture E7. Next, the mixture E7 was deposited on the deposited mixture E3. Next, the mixture E4 was deposited on the deposited mixture E7. Next, the mixture E7 was deposited on the deposited mixture E4. Next, the mixture E5 was deposited on the deposited mixture E7. Next, the mixture E7 was deposited on the deposited mixture E5. Next, the mixture E6 was deposited on the deposited mixture E7. Next, the mixture E7 was deposited on the deposited mixture E6. And, the deposited material was subjected to the heating and pressurization treatment at 200° C. After that, the deposited material was cut into 150 mm×50 mm×12 mm to form the waste ink absorber B. In the waste ink absorber B, the high density portions and the low density portions were alternately laid. Also, in the high density portion, the densities were gradually increased from the upper layer to the lower layer. Also, the maximum parts were formed in the low density portions, and the maximum parts were not formed in the high density portions. This is because the mesh sizes of the sieves are different at the time of the formations of the mixtures, and the mesh size of the sieve corresponding to the mixture E7 is larger (rougher) than the mesh sizes of the sieves corresponding to the mixtures E1 to E6.

Comparative Example 2

Formation of Waste Ink Absorber R1

A mixture in which 100 weight parts of cellulose fibers, 15 weight parts of thermoplastic resin 15, and 10 weight parts of flame retardant were mixed was screened with mesh size of 3 mm so as to form the deposited material on the mesh belt. At this time, the material was deposited so that the thickness of material became different with respect to the mesh belt MB surface. In this Example, in the same manner as the formation method as shown in the second embodiment, the deposited material was formed to become the thickness of one end part thicker than the thickness of the other end part. And, the deposited material was subjected to the heating and pressurization treatment. At this time, the flat plate H heated at 200° C. was pressed against the deposited material, and it was compressed to obtain the predetermined thickness. In this Example, the thickest portion of the deposited material was compressed into ⅛, and the thinnest portion of the deposited material was pressed to ⅕ to form the deposited material in the predetermined thickness. After that, the deposited material was cut into 150 mm×50 mm×12 mm to form the waste ink absorber R1. When the density of the waste ink absorber R1 was measured, the high density portion (0.21 g/cm$^3$) was formed in the portion corresponding to the thickest portion in the deposited material, and the low density portion (0.13 g/cm$^3$) was formed in the portion corresponding to the thinnest portion. Also, in the waste ink absorber R1, the density was changed from high to low toward the thinnest portion of the deposited material from the thickest portion. However, the maximum parts were not formed in the low density portions. This is because the mesh size of the screen is smaller (finer) than the mesh size of the screen used in Example 1.

Comparative Example 3

Formation of Waste Ink Absorber R2

Initially, the mixture E1 was deposited on the mesh belt MB. Next, the deposited mixture E1 was deposited on the mixture E2. Next, the mixture E3 was deposited on the deposited mixture E2. Next, the mixture E4 was deposited on the deposited mixture E3. Next, the mixture E5 was deposited on the deposited mixture E4. Next, the mixture E6 was deposited on the deposited mixture E5. And, the deposited material was subjected to the heating and pressurization treatment at 200°

C. After that, the deposited material was cut into 150 mm×50 mm×12 mm to from the waste ink absorber R2. In the waste ink absorber R2, the density gradient in the high density portions was confirmed. By the way, the value of the density is the same as the mixtures E1 to E6 of Example 2.

3. Evaluation

Next, in the aforementioned Examples 1 to 3 and Comparative Examples 1 to 2, the evaluation of the ink permeability, ink retaining property and ink deposition property is performed. Each evaluation method is as follows.

(a) Evaluation Methods for Ink Permeability and Ink Retaining Property

Figure 10A:
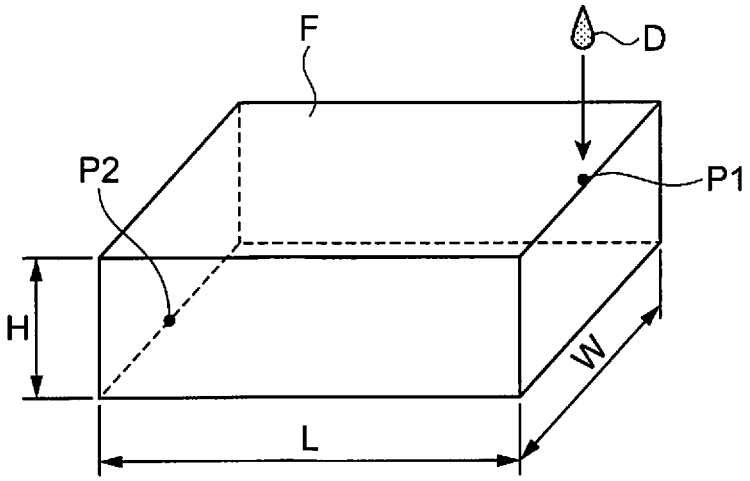
FIGS. 10A and 10B are pattern diagrams showing an evaluation method of ink permeability and retention performance of the waste ink absorber.
Figure 10B:
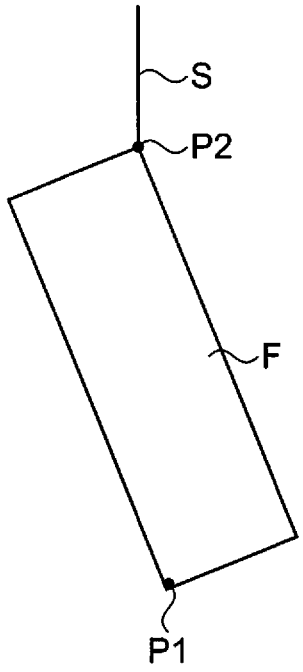

FIGS. 10A and 10B are schematic diagrams showing an evaluation method of ink permeability and retaining property of the waste ink absorber. As shown in FIG. 10A, the ink absorber F of 150 mm (L)×50 mm (W)×12 mm (H) is placed on the flat surface, and the ink of 80 ml is slowly poured from the first point P1 on the upper surface (Examples 3, 4, and Comparative Examples 2, 3 are ink 80 ml and ink 85 ml). If the ink does not impregnate in the absorber F, it is left for 5 minutes and after that, it continues to be ejected. When the ink does not permeate even if it is left for 5 minutes, it is assumed that the ink does not permeate so that the judgment of the ink permeability becomes no good. On the other hand, when all ink permeates, the judgment of the ink permeability becomes OK. When all ink was poured in, it is left for 5 minute, and then as shown in FIG. 10B, the member is hanged from the second point P2 using a strap, etc., so that the first point P1 from which the ink was poured is arranged downward. In this hanging state, the impregnated ink gathers at one end portion of the ink absorbing member F and becomes hard to be retained. When the ink drips off from the ink absorbing member F, it is assumed that ink cannot be retained, and therefore the judgment of the ink retaining property becomes NG. On the other hand, when the ink does not drip off, the judgment of the ink retaining property becomes OK. With this evaluation, it is understood that no ink will leak even if the liquid droplet ejecting device or the waste ink tank is inclined.

(b) Evaluation Method of Ink Deposition Property

An ink absorber F of 150 mm (L)×50 mm (W)×12 mm (H) is placed on a flat surface, and under the circumstance of 20% RH at 40° C., ink is dropped by 0.4 g at a time every hour on a central portion on the upper surface of the placed absorber F. After passing 240 hours, if the thickness of the solid deposited material on the surface of the ink absorber F is less than 1 mm, the judgment of the ink deposition property is OK. On the other hand, if the thickness of the deposited material is 1 mm or more, the judgment of the ink deposition property is NG.

In the aforementioned Examples and Comparative Example, the ink permeability, the ink retaining property and the ink deposition property were evaluated. The evaluation results are shown in Table 1 and Table 2.

TABLE 1

| | Ink Permeability | Ink Retaining Property | Ink Deposition Property |
|---|---|---|---|
| Example 1 | OK | OK | OK |
| Example 2 | OK | OK | OK |
| Comparative Example 1 | OK | NG | OK |

As shown in Table 1, according to the waste ink absorbers A, B, C (Examples 1, 2) according to the invention, all of evaluations on the ink permeability, the ink retaining performance, and the ink deposition property were excellent. On the other hand, in the waste ink absorber R of Comparative Example 1, no satisfactory result could be obtained in terms of the ink retaining property. Comparative example 1 does not have the maximum parts so that the permeability was excellent but the retaining property was not good. On the other hand, since Examples 1 and 2 have the maximum parts, the retaining property was excellent and in addition, the permeability and the deposition property in the low density portions were excellent.

In some cases, the low density portions and the maximum parts, which are features of this application can be recognized by the appearance by eye because the maximum parts have higher density than the low density portions so that it is darker as a visual appearance. However, in some cases, the difference cannot be recognized by eye. As a method of verification on that case, when the ink was dropped, while spreading along the path, if there was a portion where the dark color was recognized because the ink was locally absorbed, it can be said that there were the maximum parts. By the way, in the case that the entire waste ink absorber is the uniform in density, when the ink was dropped, the ink was gradually impregnated so that the color in the dropped portion became darker, and the color was gradually faded as it was away from the dropped portion. There is no case that the color becomes darker when the ink is locally dispersed and absorbed.

TABLE 2

| | Ink Ejected Amount 80 ml | | Ink Ejected Amount 85 ml | | |
|---|---|---|---|---|---|
| | Ink Permeability | Ink Retaining Property | Ink Permeability | Ink Retaining Property | Ink Deposition Property |
| Example 3 | OK | OK | OK | OK | OK |
| Example 4 | OK | OK | OK | OK | OK |
| Comparative Example 2 | OK | OK | NG | NG | NG |
| Comparative Example 3 | OK | OK | NG | NG | NG |

As shown in Table 2, in Example 3 and Example 4 (waste ink absorber C, D) according to the invention, the evaluations of all of the ink permeability, the ink retaining property, and the ink deposition property were excellent for the ink ejected amount of 80 ml and 85 ml. On the other hand, in Comparative Example 2 and Comparative Example 3 (waste ink absorbers R1, R2), the ink permeability and the ink retaining property for the ink ejected amount of 80 ml were OK, but the ink permeability and the ink retaining property for the ink ejected amount of 85 ml were NG. Also, the ink deposition properties were NG, respectively, so that the satisfying results were not obtained. That is, the ink retention ability in Example 3 and Example 4 (waste ink absorbers C, D) were more excellent than Comparative Example 2 and Comparative Example 3 (waste ink absorbers R1, R2) so that the absorption tolerance of the ink can be increased. This is because the ink retaining property was improved by forming the maximum parts in the low density portions of Example 3 and Example 4 (waste ink absorbers C, D). By the way, when the ink ejected amount of 80 ml can be impregnated and retained, it has an adequate high ability, but Example 3 and Example 4 had the satisfying results even when it was the ink ejected amount of 85 ml so that they have more excellent ability.

In some cases, the low density portions and the maximum parts, which are features of this application can be recognized by the appearance by eye because the maximum parts have higher density than the low density portions so that it is darker as a visual appearance. However, in some cases, the difference cannot be recognized by eye. As a method of verification on that case, when the ink was dropped, while spreading along the path, if there was a portion where the dark color was recognized because the ink was locally absorbed, it can be said that there were the maximum parts. By the way, in the case that the entire waste ink absorber is the uniform in density, when the ink was dropped, the ink was gradually impregnated so that the color in the dropped portion became darker, and the color was gradually faded as it was away from the dropped portion. There is no case that the color becomes darker when the ink is locally spread and absorbed. Also, in the low density portions and the high density portions, the speeds of the ink impregnations are different. By the way, when the density is uniformed in the entire waste ink absorber, the speed of the ink impregnation does not change depending on the position where the ink is dropped.

The aforementioned Examples are employed as a waste ink tank 300 (300*a*, 300*b*, 300*c*, 300*d*) and a waste ink tank 200 (200*a*, 200*b*, 200*c*) for use in a liquid droplet ejecting device 10. Here, ink includes various kinds of liquid compositions, such as, common aqueous ink, oil ink, pigment ink, dye ink, solvent ink, resin ink, sublimation transfer ink, gel ink, hot melt ink, ultraviolet cure ink, etc. Further, ink can be any materials that a head 24 can eject. For example, it is enough that the material is in a liquid phase state, and ink includes not only liquid crystal, a liquid state material high or low in ink viscosity, sol, gel liquid, fluid material such as inorganic solvent, organic solvent, solution, liquid resin, liquid metal (metal thermoplastic solution), liquid as one condition of a material, but also a material in which functional material particles of solid materials such as pigments or metal particles are dissolved, dispersed or mixed in a solvent, etching liquid, lubricating oil. Further, the liquid droplet ejecting device can be, other than an ink jet printer, a device for ejecting ink including electrode materials or materials such as coloring materials used to produce, for example, a liquid crystal display, an EL (electroluminescence) display, a surface emitting display, or a color filter in a dispersed or dissolved manner, a device for ejecting a bio organic substance for use in a bio chip production, a device for ejecting ink as a sample used as a precision pipette, a printing device or a micro dispenser. Furthermore, a device for ejecting lubricating oil to a precision machine such as a clock, a camera, etc., at a pin point, a device for forming, e.g., a small rounded lens (optical lens) for use as an optical communication element, a device for ejecting ultraviolet curable liquid and hardening it by light or heat, or a device for ejecting etching liquid such as acid, alkali, etc., to etch a substrate, etc., can be employed. The invention can be applied to any one of liquid droplet ejecting device among these devices.

In the aforementioned Examples, in order to prevent fluffing of the surface of a waste ink absorber 200, a thin non-woven fabric can be adhered to the surface. Since the non-woven fabric to be adhered is thin as compared with the waste ink absorber 200, the influence to the ink permeability or retaining performance is small. In the aforementioned Examples, the waste ink absorber 200 is formed into a rectangular shape, but not limited to it. A rectangular shape can partially have a cutting and/or dent, and the shape can be non-rectangular and include an arc portion and/or an inclined portion. In the drawings of the aforementioned Examples, the ratio of the maximum parts 210 can be changed in response to the ink. For example, when the ink has high ink viscosity and it is not easily impregnated, it is preferable that the ratio of the maximum parts 210 is reduced and the ratio of the low density portion is increased. On the other hand, when the ink viscosity is small and it is easily impregnated, it is preferable that the ratio of the maximum parts 210 is increased and the ratio of low density portion is reduced. In the drawings of the aforementioned Examples, it was drawn that the ratio of the low density portion and the ratio of the high density portion become almost same. It can be changed depending on the ink. For example, when the ink has high ink viscosity and it is not easily impregnated, it is preferable that the thickness of the low density portion is larger than the thickness of the high density portion so that it is easily impregnated. On the other hand, when the ink viscosity is small and it is easily impregnated, it is preferable that the thickness of the low density portion is smaller than the thickness of the high density portion. Also, the ratio of the maximum parts can be changed depending on the ink.

In the aforementioned Examples, the pulp sheet includes a wood pulp of a conifer, a broad-leaf tree, etc., non-wood plant fibers such as hemp, cotton, kenaf, etc. In the aforementioned Examples, cellulose fibers are mainly used, but it is not limited to cellulose fibers as long as it is a material which can absorb ink and differentiate the density. The fiber can be a fiber made from plastic such as polyurethane or polyethylene terephthalate (PET) or another fiber such as wool. The method of forming the waste ink absorber is not limited to the method recited in the aforementioned Examples. As long as the features of the present application can be exerted, another production method such as a wet type method can be employed.

What is claimed is:

1. A waste ink absorber to absorb waste ink discharged from a head for ejecting ink, comprising:

a plurality of maximum parts where the density is locally high and a low density portion where the density is lower than the maximum parts in an uncompressed state, the maximum parts being formed of cellulose fibers, the maximum parts and the low density portion being provided in a single piece of the waste ink absorber, the waste ink absorber having a surface extending along a first direction, the maximum parts being dispersed in the low density portion in the first direction and a second direction perpendicular to the first direction such that the maximum parts are arranged separately from each other in the first and second directions in the low density portion and the low density portion is disposed between each of the maximum parts.

2. The waste ink absorber according to claim 1, wherein a surface of the waste ink absorber is a flat surface.

3. The waste ink absorber according to claim 1, wherein the maximum parts do not include thermoplastic resin.

4. The waste ink absorber according to claim 3, wherein the low density portion includes cellulose fibers and thermoplastic resin.

5. The waste ink absorber according to claim 1, further comprising: a high density portion where the density is higher than the low density portion, wherein the maximum parts are dispersed in the low density portion.

6. The waste ink absorber according to claim 5, wherein the high density portion and the low density portion are formed in a single piece of the waste ink absorber.

7. The waste ink absorber according to claim 5, wherein the density is gradually changed from the high density portion to the low density portion in the single piece of the waste ink absorber.

8. The waste ink absorber according to claim 5, wherein the high density portions and the low density portions are alternately laid, and in a plurality of laid high density portions, the density is gradually increased in a laying direction.

9. The waste ink absorber according to claim 5, wherein the high density portion is arranged in the first direction relative to the low density portion in which the maximum parts are dispersed, and a thickness in the second direction of the high density portion is equal to a thickness in the second direction of the low density portion.

10. A waste ink tank comprising:

the waste ink absorber according to claim 1; and a container portion for containing the waste ink absorber.

11. A liquid droplet ejecting device comprising:

the waste ink tank according to claim 10 for capturing waste ink discharged from the head.

* * * * *